United States Patent [19]

Rafferty

[11] Patent Number: 4,765,498

[45] Date of Patent: Aug. 23, 1988

[54] VACUUM-INDICATING CLOSURE FOR CONTAINERS

[76] Inventor: Charles A. Rafferty, 15 Waterville Rd., Farmington, Conn. 06032

[21] Appl. No.: 54,527

[22] Filed: May 27, 1987

[51] Int. Cl.[4] ..... B65D 41/04

[52] U.S. Cl. ..... 215/230; 215/271

[58] Field of Search ..... 215/230, 271, 365, 276; 116/67 R, 70, 205; 220/DIG. 16

[56] References Cited

U.S. PATENT DOCUMENTS

| | | | |
|---|---|---|---|
| 2,449,014 | 9/1948 | Shaffer | 215/260 |
| 3,160,302 | 12/1964 | Chaplin | 215/271 |
| 3,930,592 | 1/1976 | Dilanni | 215/365 X |
| 4,093,094 | 6/1978 | Smalley et al. | 215/276 |
| 4,398,491 | 8/1983 | Fridl et al. | 215/262 X |
| 4,674,642 | 6/1987 | Towns et al. | 215/230 |

*Primary Examiner*—Donald F. Norton
*Attorney, Agent, or Firm*—Dallett Hoopes

[57] ABSTRACT

A closure for a container of food or the like sold under vacuum comprises a domed lid of sheet material and a screw-top cover adapted to hold the lid in sealing engagement over the mouth of the container. The top panel of the cover has a central opening up into which extends in depressible fashion a button having a flange about its base, the flange being retained between the lid and cover. When the closure is applied to a product under vacuum, the dome of the lid is drawn down. The button will appear "down," and it will feel down and not depressible. If vacuum is lost, the dome is up, and the button will appear "up" and will feel "up" and depressible. Further, when pressed, the button causes the lid to snap or "oil can" audibly to indicate loss of vacuum.

10 Claims, 1 Drawing Sheet

VACUUM-INDICATING CLOSURE FOR CONTAINERS

BACKGROUND OF THE INVENTION

1. Field of the Invention

This invention relates to a closure for a container which is supposed to be sold under a vacuum to protect the contents from spoiling or to assure that the contents have not been tampered with. More specifically, the invention relates to such a closure provided with a simple and foolproof means for testing that the vacuum has not been lost.

2. Discussion of the Prior Art

The prior art is, of course, replete with closures of many descriptions. However, the prior art discloses few container closures having visual and sensory and audible means for indicating the presence of a vacuum.

In the art there are one-piece metal screw-type caps with domed portions that can be pressed down by the shopper to click if there is a loss in vacuum. Also, there are two-piece caps for canning jars that include a metal lid that is drawn down under vacuum.

An indicator operable by the consumer at point of use is disclosed in Fridle et al U.S. Pat. No. 4,398,491, wherein a tape may be stripped off an aperture in the can to cause a whistling sound when air rushes in. Obviously the vacuum is spoiled when the test device is used.

A pressure indicator, as opposed to a vacuum indicator, is disclosed on the beer can structure disclosed in DiIanni U.S. Pat. No. 3,930,592, which issued Jan. 6, 1976. This patent discloses a beer can having a wall section which bows outward to show that the beer is under pressure, and when the pressure is lost, as in the opening of the can or the leaking of gas therefrom, the section snaps back to its original condition.

SUMMARY OF THE INVENTION

This invention relates to a closure for a container which gives audible, visible and discernible to the touch indications of the presence or lack of vacuum within the container. It is designed primarily for commercial use with foods, an example being spaghetti sauces, which are popularly packaged in glass jars having screw-top lids. It is important that the original vacuum developed as the product was cooling after it has been sealed be maintained in order to preclude entry of bacteria into the container, which would, of course, cause the product to go bad. The present invention is also useful, of course, where the product is packed in a vacuum atmosphere, and then the container is sealed, sealing in the vacuum.

Under the present invention a neat, attractive arrangement is proposed by which the container can be tested at point of purchase or use without destroying any present vacuum. The structure involves a push button which will extend up above the cover if the vacuum is lost, and pressing the button will result in an audible click if the vacuum has been lost. The presence of vacuum will result in the button feeling "bottomed out" or not depressible.

More specifically, the invention is a closure comprising a lid of sheet material having in repose a domed shape and sealing means on its underside adjacent its periphery. The lid is adapted to oil can, or buckle or snap from the domed shape to a second more downward shape, when it is pressed downward. Button means are provided extending upward from the center of the lid, and also provided is a cover having a downward side wall formed with inward threads to engage the container threads and having a top panel which is aperture to permit passage of the button.

By this arrangement, when a vacuum exists in the container, the lid will assume its more downward oil-can condition, but when the vacuum is lost, the lid will dome up to its upward oil-can position above the top of the cover. In the non-vacuum condition, the lid can be oil-canned up and down to make audible clicking sounds.

Other features and objects of the invention will be clear from the following specification, including claims and drawings all of which disclose a non-limiting form of the invention. In the drawings:

FIG. 3 shows in broken lines the contour of the lid when the button is depressed to produce the oil can audible snapping effect.

DESCRIPTION OF THE PREFERRED EMBODIMENT

Figure 1:
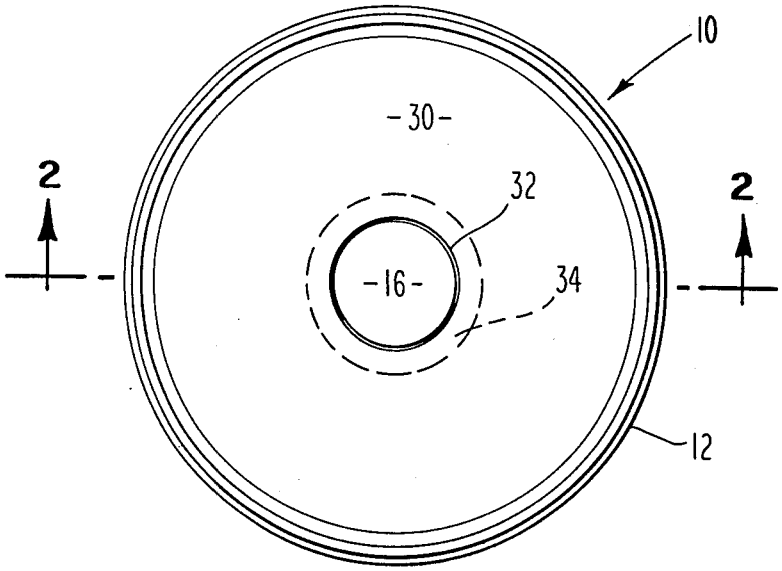
FIG. 1 is a top plan view of a closure embodying the invention.

More specifically, a closure embodying the invention is designated 10 in FIG. 1, and comprises a cover 12, a lid 14 and button means 16. As shown, the lid 14 has a domed shape **14*a*** which commences slightly spaced in from its margin.

The underside of the lid adjacent its periphery is provided with a channel receiving a sealing means 18, which is preferably a hard, resilient gasket material in the instance in which the vacuum is created by the cooling of the head space 20 above the product P in the container C. Alternatively, when the product is capped in a vacuum environment, the sealing means 18 may be a gasket of softer material. The perimeter of the lid 14 includes a downturned flange 22 which helps center the gasket.

The lid material is preferably metal, which may be selected of appropriate thickness and temper. It has been found that a steel designated 55 DR9 (continuously annealed) has performed entirely satisfactorily for this purpose. The material of dome **14*a*** oil cans, as explained above. This characteristic, standard in canning lids, for instance, is a result of impressing a force on the center of the lid while holding the rim of the lid stationary.

The cover 12, preferably molded polystyrene, includes the side walls 24 having internal threads 26 adapted to engage the threads T of the mouth of the container C. The side wall is also formed with a circumferential inward ridge 28 inclined inward and upward on its lower surface to provide a lead-in for the installation of the lid. In installation the ridge engages under the downturned flange 22 of the lid, and hence, in use, as the cover 12 is unscrewed, the ridge 28 picks the lid 14 up by urging upward on its flange 22 to break the vacuum in the container C.

The cover 12 also includes the top panel 30 which is horizontal and engages adjacent it periphery the upper side of the lid above the channel in which the gasket 18 rests. The panel is formed with a central opening 32 which permits close but uninhibited passage of the upper part of the cylindrical button 16. About the base of the button 16 on annular flange 34 extends outward.

Figure 2:
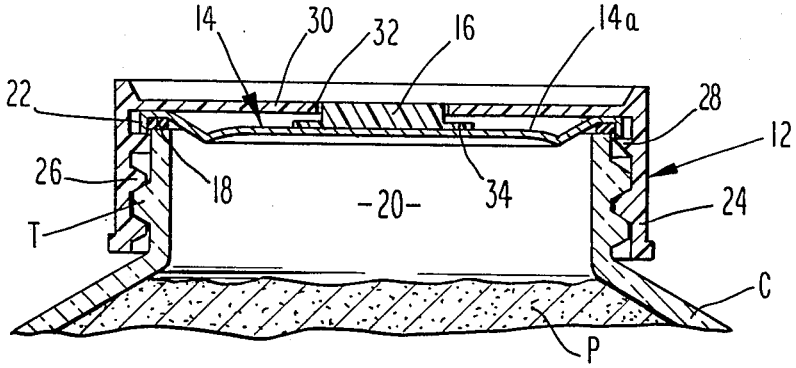
FIG. 2 is a fragmentary sectional view showing the closure installed tightly on a container under vacuum.

The unit is assembled for forcing the lid upward beyond the ridge 28 to permanently install the lid in the cover 12. Prior to doing this the button 16 is centered on the domed portion 14*a* so that the upper end of the button 16 extends into opening 32. The top panel masks all the lid and all but the top of the button. In the arrangement shown in FIG. 2, the container C is under vacuum and the domed center portion of the lid 14 is pulled to its more downward position so that the lid is virtually disposed in a horizontal plane. The button 16 under this condition is not depressible, but "feels" solid and "bottomed out" when pushed, because the lid is already held by the vacuum in its downward condition.

Figure 3:
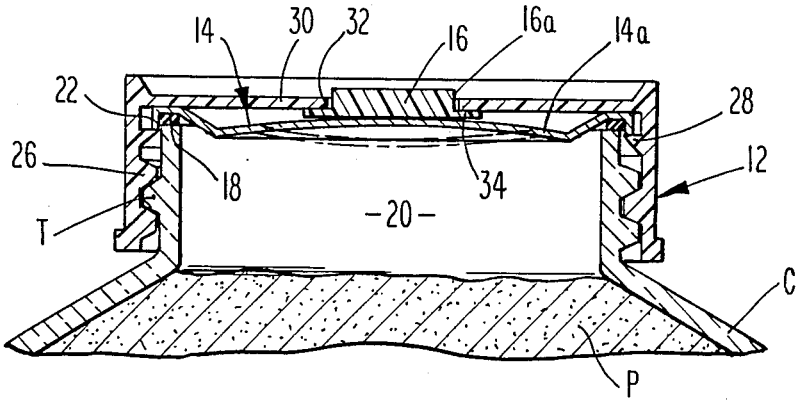
FIG. 3 is a view similar to FIG. 2 but in which the vacuum has been lost even though the closure is tightly installed on the container.

In FIG. 3, due to some reason, either previous entry into the container by a curious but uncommitted shopper or by a loss under the gasket 12 due to irregularities in the gasket or lip of the container, vacuum is lost. This has caused the central portion of the lid to resume its upwardly domed condition even though the cover is still screwed tightly down onto the container. The button will "ride high," that is, its top surface (FIG. 3) will be above that of the cover and a portion of the side of the button will be visible. Pressing the button 16 with the lid condition shown in FIG. 3 will result in a clicking noise as the lid oil cans from its upper to its lower contour and back again.

Subsequently, any removal of the cover 12 will take with it the lid 14 by virtue of the lid retaining ridge 28. Thereafter, the returning of the cover to the FIG. 2 disposition will result in the gentle upward convex doming of lid 14 and the familiar clicking sound when the button 16 is pressed.

It should be understood that lid 14 may be respecified, changing its character so that it will oil can downward to a lesser or greater vacuum inside the container. For instance, the lid can be made to oil can at as low a pressure as three inches of mercury or up to twenty inches, if need be. In either case, loss of such a vacuum will result in the condition shown in FIG. 3 and the oil canning when the button 16 is pressed.

"Oil can" herein is used as a verb to describe the snapping action as in the bottom wall of a metal oil can wherein the metal shifts from a convex shape outward to a concave or at least no-so-convex shaped. No simple other descriptive phrase has been noted.

Proportioning of the button 16 is very preferably such that when the dome 14*a* is in its upward contour, as shown in FIG. 3, a portion of the button extends beyond the level of the top surface of the panel 30, giving a visual indication of the lack of vacuum.

Preferably, the button 16 is of a relatively hard plastic. Delrin or some less expensive substitutes have been found satisfactory. It is envisioned that the button may be integrally formed with the lid 14 in the form of a central integrally upwardly drawn cup with an oil-canning flange all around it outward to the gasket. However, because of simplicity the version shown in the drawings, wherein the button is a separate part from the lid, is preferred.

Thus, variations in the article comprising the invention are possible, and it is practical in many forms other than that shown. The protection, therefore, that is sought can be defined in terms of the following language and equivalents thereof.

I claim:

1. A vacuum-indicating closure for containers comprising a lid of metal sheet material having in repose a slightly domed shape and sealing means on its underside adjacent its periphery, the lid being adapted to snap audibly when its center is pressed downward, button means separate from the lid extending upward from the center of the lid, and a cover having a downward sidewall formed with inwardly directed container-engaging coupling means and a top panel with a central opening through which the button means is accessible to be pressed to indicate audibly loss of vacuum.

2. A vacuum-indicating closure as claimed in claim 1 wherein the sidewall has inward means above the coupling means adapted to hold the lid up adjacent the top panel.

3. A vacuum-indicating closure as claimed in claim 1 wherein the button means has a top surface extending above the top surface of the panel when the lid is in its domed condition.

4. A vacuum-indicating closure as claimed in claim 3 wherethe button means includes outward means spaced downward from its top surface and disposed in between the cover and the lid.

5. A vacuum-indicating closure as claimed in claim 1 wherein the coupling means are internal threads or portions thereof.

6. A food container closure having an audible indicator of vacuum loss comprising:

a. an outer screw-type cover having a sidewall formed with inward threads and a top panel formed with a central opening, b. an inner generally disc-shaped metal lid having a normally upwardly directed dome and adapted to snap audibly downward when depressed, an upward peripheral channel thereabout fitted with downwardly facing gasket material, the lid being generally coextensive with and disposed under the top panel, and c. a button element separate from the lid and having an upper portion extending into the central opening, and retaining means wider than the opening extending out from the button and disposed between the cover and the lid, whereby when the closure is on a container under vacuum the center of the lid is held down by the vacuum and when the vacuum is broken the lid domes up and the button may be manually depressed to snap it audibly.

7. A food container closure as claimed in claim 6 wherein the cover has inward lid-engaging and retaining means above the threads to hold the lid closely under the top panel.

8. A food container closure as claimed in claim 6 wherein the button means has a top surface extending above the top surface of the panel when the center of the lid is in its upward condition.

9. A closure for a container having an audible test for loss of vacuum comprising:

a. a circular metal lid means having a downwardly facing gasket about its periphery adapted to seal against the mouth of a container and an upwardly gently convex shape in repose and having button means separate from the lid and formed with generally vertical sidewalls extending up from its center, the gently convex portion being adapted to snap audibly downward when subjected to pressure from above, and b. a cover element including inwardly threaded sidewalls adapted to engage mating threads on a container and hold down the lid means, the cover element having a top panel extending inward to a central opening and masking all of the lid means except for the button means, whereby when the closure is installed on the container and the container is under vacuum, the button means will be in depressed position and the button means cannot be depressed because the lid means shape is held downward by the vacuum, but after loss of vacuum the lid means audibly snaps downward upon depressing the button means.

10. A closure for a container as claimed in claim 9 wherein the button means is a cylinder having a retaining flange about its lower end and the flange is disposed between the cover element and the lid means.

* * * * *